US011852372B2

(12) United States Patent
Bhosale et al.

(10) Patent No.: US 11,852,372 B2
(45) **Date of Patent: *Dec. 26, 2023**

(54) AUXILIARY HEAT EXCHANGER FOR HVAC SYSTEM

(71) Applicant: Johnson Controls Tyco IP Holdings LLP, Milwaukee, WI (US)

(72) Inventors: Anil V. Bhosale, District Satara (IN); Ketan S. Khedkar, Pune (IN); Nikhil N. Naik, Ratnagiri (IN); Hambirarao S. Sawant, Belgaum (IN); Neelkanth S. Gupte, Katy, TX (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/870,442

(22) Filed: Jul. 21, 2022

(65) Prior Publication Data

US 2022/0357056 A1 Nov. 10, 2022

Related U.S. Application Data

(63) Continuation of application No. 16/366,861, filed on Mar. 27, 2019, now Pat. No. 11,397,014.
(Continued)

(51) Int. Cl.
*F24F 3/044* (2006.01)
*F24F 1/0323* (2019.01)
(Continued)

(52) U.S. Cl.
CPC ..... *F24F 3/044* (2013.01); *F24F 1/0323* (2019.02); *F24F 11/84* (2018.01); *F24F 13/20* (2013.01); *F24F 13/30* (2013.01); *F24F 2221/16* (2013.01)

(58) Field of Classification Search
CPC . F24F 1/0323; F24F 1/028; F25B 6/00; F25B 6/02; F25B 6/04
See application file for complete search history.

(56) References Cited

U.S. PATENT DOCUMENTS 2,391,507 A 12/1945 Philipp
2,703,702 A 3/1955 Meinel
(Continued)

FOREIGN PATENT DOCUMENTS

CN 204612016 U 9/2015
CN 207351267 U 5/2018
(Continued)

OTHER PUBLICATIONS

A. Paliwoda, "Generalized Method of Pressure Drop and Tube Length Calculation with Boiling and Condensing Refrigerants within the Entire Zone of Saturation," Research Institute for Food Processing Machinery, International Journal of Refrigeration, vol. 12, Nov. 1989.
(Continued)

*Primary Examiner* — Christopher R Zerphey
(74) *Attorney, Agent, or Firm* — Fletcher Yoder, P.C.

(57) ABSTRACT

A heating, ventilation, and/or air conditioning (HVAC) system, includes a housing having a wall with an exterior surface configured to be exposed to an ambient environment. The HVAC system further includes a first heat exchanger disposed within the housing and forming part of a refrigerant circuit of the HVAC system and a second heat exchanger disposed within the housing and forming part of the refrigerant circuit, in which the second heat exchanger includes a coil coupled to the wall, such that the coil and the wall are configured to transfer heat between the ambient environment and refrigerant passing through the second heat exchanger.

20 Claims, 9 Drawing Sheets

Related U.S. Application Data

(60) Provisional application No. 62/824,078, filed on Mar. 26, 2019.

(51) Int. Cl.

| | |
|---|---|
| ***F24F 11/84*** | (2018.01) |
| ***F24F 13/20*** | (2006.01) |
| ***F24F 13/30*** | (2006.01) |

(56) References Cited

U.S. PATENT DOCUMENTS

| | | | | |
|---|---|---|---|---|
| 3,153,919 | A | 10/1964 | Jernigan | |
| 3,174,539 | A * | 3/1965 | Pietsch | F24F 1/0323 165/76 |
| 3,220,212 | A | 11/1965 | Fordsmand | |
| 3,313,122 | A * | 4/1967 | Laing | F24F 1/027 62/263 |
| 3,545,224 | A * | 12/1970 | Nicoski | F24F 1/0325 62/262 |
| 3,665,727 | A * | 5/1972 | Mather | F24F 1/0323 62/262 |
| 3,692,100 | A | 9/1972 | Gallagher, Jr. | |
| 3,714,795 | A | 2/1973 | Fowell et al. | |
| 3,776,305 | A * | 12/1973 | Simmons | F28D 15/06 165/41 |
| 4,024,620 | A * | 5/1977 | Torcomian | F25D 23/061 156/286 |
| 4,911,234 | A | 3/1990 | Heberer et al. | |
| 5,033,361 | A | 7/1991 | Moszkowski | |
| 5,423,498 | A * | 6/1995 | Fluegel | B64D 13/00 165/41 |
| 5,513,500 | A | 5/1996 | Fischer et al. | |
| 5,931,381 | A | 8/1999 | Fiedrich | |
| 5,964,101 | A | 10/1999 | Schulak et al. | |
| 6,658,881 | B1 | 12/2003 | Plattner | |
| 7,089,756 | B2 | 8/2006 | Hu | |
| 7,155,928 | B2 | 1/2007 | Takegami et al. | |
| 8,627,670 | B2 | 1/2014 | Moraes et al. | |
| 8,820,111 | B2 * | 9/2014 | Adomat | F25B 6/04 62/428 |
| 9,086,223 | B2 | 7/2015 | Vandermeulen et al. | |
| 9,175,893 | B2 | 11/2015 | Junge et al. | |
| 9,309,000 | B2 * | 4/2016 | Piesker | B64D 13/00 |
| 9,513,022 | B2 | 12/2016 | Zhong et al. | |
| 9,631,834 | B2 * | 4/2017 | Uselton | F24F 5/00 |
| 9,683,704 | B2 | 6/2017 | Tamburello et al. | |
| 9,784,481 | B2 | 10/2017 | Kawano et al. | |
| 9,915,437 | B2 | 3/2018 | Aynur et al. | |
| 10,011,362 | B2 * | 7/2018 | Piesker | F28F 1/02 |
| 10,274,246 | B2 | 4/2019 | Kagawa et al. | |
| 10,634,367 | B2 * | 4/2020 | De' Longhi | F25B 40/02 |
| 10,697,705 | B2 * | 6/2020 | Yamamoto | F25B 13/00 |
| 11,397,014 | B2 * | 7/2022 | Bhosale | F24F 11/84 |
| 2008/0184713 | A1 | 8/2008 | Huff et al. | |
| 2011/0146957 | A1 * | 6/2011 | Buchholz | B64D 13/00 165/104.26 |
| 2012/0048521 | A1 | 3/2012 | Reifel et al. | |
| 2013/0340455 | A1 | 12/2013 | Martin et al. | |
| 2015/0345845 | A1 * | 12/2015 | Nakatsu | F25B 45/00 62/77 |
| 2017/0307251 | A1 | 10/2017 | Baruch | |
| 2019/0178561 | A1 | 6/2019 | Marinello et al. | |

FOREIGN PATENT DOCUMENTS

| | | |
|---|---|---|
| DE | 3205331 A1 | 8/1983 |
| DE | 9317404 U1 | 3/1994 |

OTHER PUBLICATIONS

Domanski, et al. "An Improved Two-Phase Pressure Drop Correlation for 180° Return Bends," National Institute of Standards and Technology, 3rd Asian Conference on Refrigeration and Air-Conditioning, May 2006.

Pradip Bhambure, Modeling and Energy Analysis of Hot Wall Condenser for Domestic Refrigerator, May 2016, pp. 69, College of Engineering, Pune (COEP), India.

* cited by examiner

AUXILIARY HEAT EXCHANGER FOR HVAC SYSTEM

CROSS REFERENCE TO RELATED APPLICATIONS

This application is a continuation of U.S. patent application Ser. No. 16/366,861, entitled "AUXILIARY HEAT EXCHANGER FOR HVAC SYSTEM," filed Mar. 27, 2019, which claims priority from and the benefit of U.S. Provisional Application Ser. No. 62/824,078, entitled "AUXILIARY HEAT EXCHANGER FOR HVAC SYSTEM," filed Mar. 26, 2019, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Environmental control systems are utilized in residential, commercial, and industrial environments to control environmental properties, such as temperature and humidity, for occupants of the respective environments. The environmental control system may control the environmental properties through control of an air flow delivered to the environment. For example, a heating, ventilation, and air conditioning (HVAC) system may circulate a refrigerant and place the refrigerant in a heat exchange relationship with an air flow to condition the air flow. In some cases, the HVAC system may include a heat exchanger configured to remove heat from the refrigerant. However, a capacity of the heat exchanger to remove the heat from the refrigerant may be limited.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system, includes a housing having a wall with an exterior surface configured to be exposed to an ambient environment. The HVAC system further includes a first heat exchanger disposed within the housing and forming part of a refrigerant circuit of the HVAC system and a second heat exchanger disposed within the housing and forming part of the refrigerant circuit, in which the second heat exchanger includes a coil coupled to the wall, such that the coil and the wall are configured to transfer heat between the ambient environment and refrigerant passing through the second heat exchanger.

In another embodiment, a heating, ventilation, and/or air conditioning (HVAC) system includes a housing having a wall with a first side exposed to an ambient environment surrounding the housing and a second side having insulation coupled thereto. The HVAC system also includes a first heat exchanger disposed within the housing and along a circuit, in which the first heat exchanger is configured to transfer heat between an air flow and a refrigerant directed through the circuit, and a second heat exchanger disposed within the housing and along the circuit, in which the second heat exchanger is coupled to the insulation, and the second heat exchanger is configured to receive the refrigerant and transfer heat from the refrigerant to the ambient environment via the insulation and the wall. The HVAC system further includes a conduit assembly of the circuit coupled to the first heat exchanger and the second heat exchanger, in which the conduit assembly is configured to direct the refrigerant to the first heat exchanger and the second heat exchanger in a parallel arrangement.

In another embodiment, a heating, ventilation, and/or air conditioning (HVAC) system includes a housing having a wall with an exterior surface configured to be exposed to an ambient environment and an interior surface configured to be exposed to an interior of the housing, a first heat exchanger disposed within the interior of the housing, and a second heat exchanger having a coil coupled to the interior surface of the wall to enable heat transfer between the ambient environment and refrigerant flowing through the coil. The HVAC system further includes a conduit assembly coupled to the first heat exchanger and the second heat exchanger and having a valve configured to direct the refrigerant to the first heat exchanger and the second heat exchanger in a parallel arrangement, and a controller configured to adjust a position of the valve to control amounts of the refrigerant directed to the first heat exchanger and the second heat exchanger.

DRAWINGS

Various aspects of this disclosure may be better understood upon reading the following detailed description and upon reference to the drawings in which.

DETAILED DESCRIPTION

Figure 1:
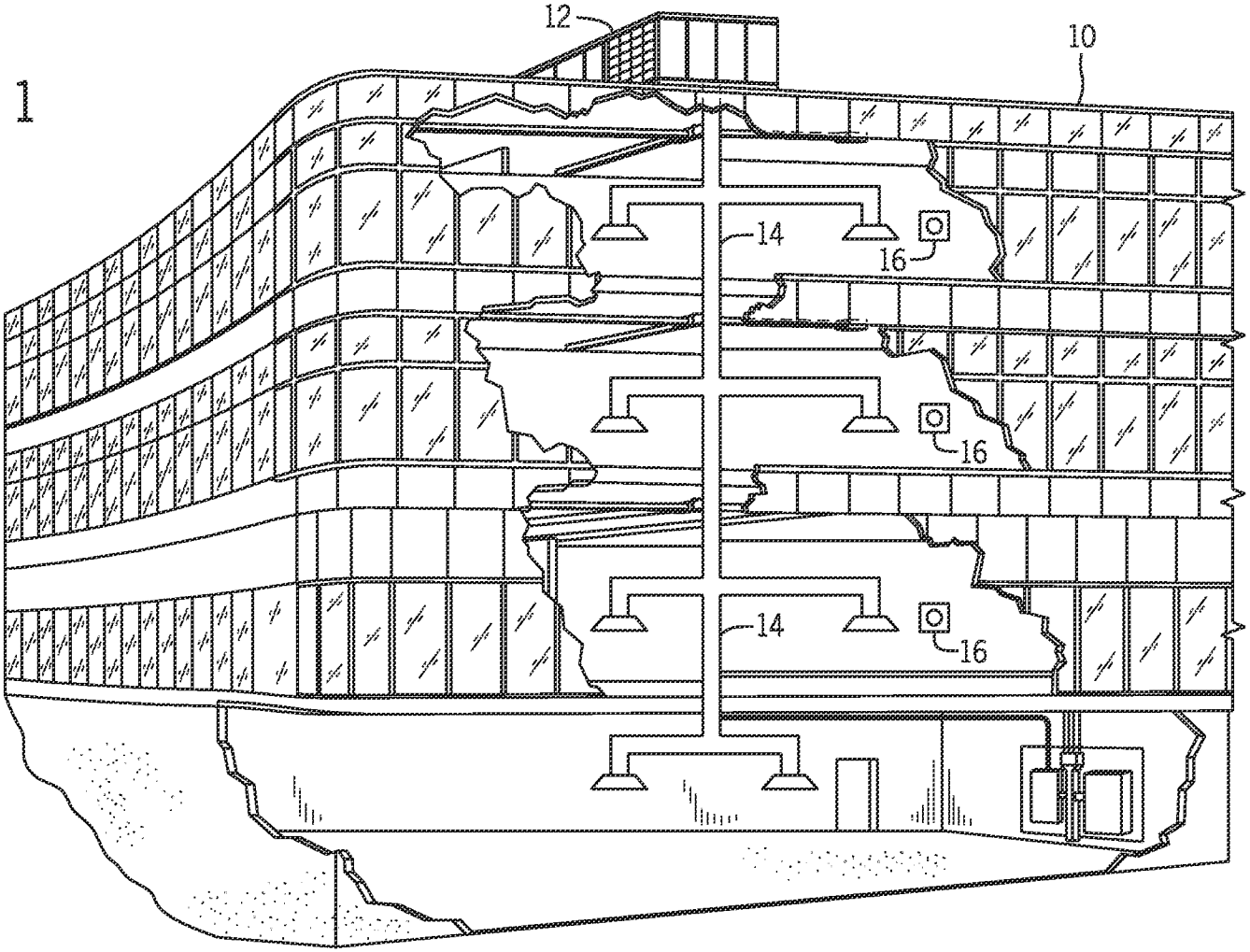
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system that includes a refrigerant circuit configured to circulate a refrigerant in order to condition an environment, such as a building or a home. For example, the refrigerant may be pressurized by a compressor of the refrigerant circuit and may be directed toward a condenser of the refrigerant circuit, where the pressurized refrigerant is cooled and condensed. The cooled refrigerant may then be directed to an evaporator of the refrigerant circuit to be placed in a heat exchange relationship with a supply air flow. Heat exchange between the supply air flow and the refrigerant within the evaporator causes the supply air flow to cool before the supply air flow is delivered to the environment conditioned by the HVAC system.

In some embodiments, the HVAC system utilizes a fan configured to direct or draw air across the condenser to remove heat from the refrigerant within the condenser. A speed of the fan may be controlled based on a desired amount of cooling of the refrigerant in the condenser. For example, the fan speed may be increased to increase the amount of cooling of the refrigerant. However, increasing the fan speed also increases energy consumption of the HVAC system, and thus, the capacity of the condenser to cool the refrigerant may be limited by the operation of the fan as well as energy consumption limits.

Accordingly, embodiments of the present disclosure are directed to an auxiliary heat exchanger that may be included in the HVAC system to increase a capacity for cooling the refrigerant. For example, a portion of the refrigerant in the refrigerant circuit may be directed to the auxiliary heat exchanger, which may reduce an amount of refrigerant directed to a primary heat exchanger, such as the condenser utilizing the fan. In certain embodiments, the auxiliary heat exchanger may place the refrigerant in a heat exchange relationship with ambient air to cool the refrigerant without using mechanical circulation devices, such as fans, to facilitate cooling, which may reduce an amount of energy consumption by the HVAC system. In other embodiments, the auxiliary heat exchanger may utilize an auxiliary fan to increase a cooling capacity of the auxiliary heat exchanger. In any case, a speed of the fan may be reduced as a result of the reduction in refrigerant flowing through the primary heat exchanger, such as the condenser. As such, the auxiliary heat exchanger may increase an efficiency of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
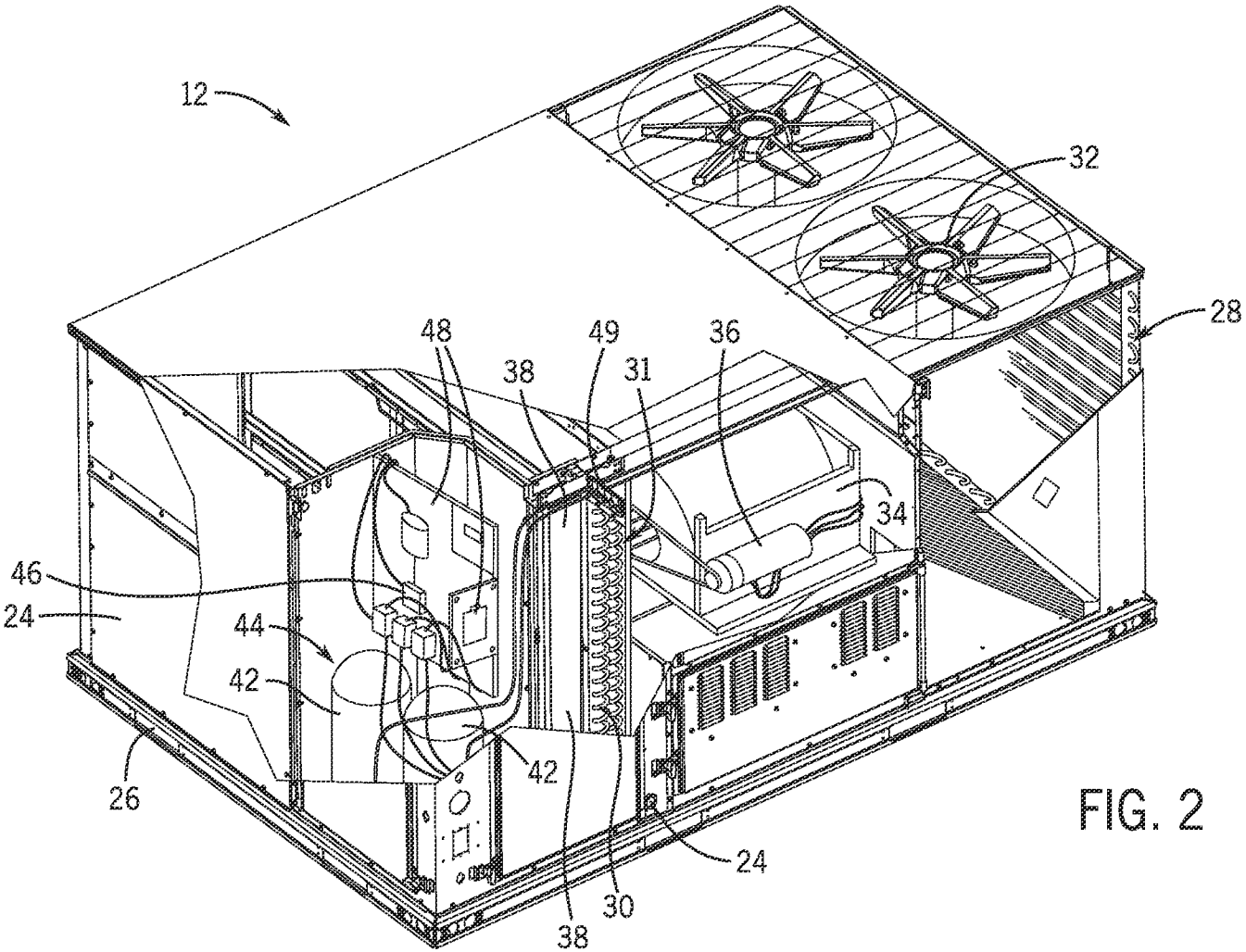
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
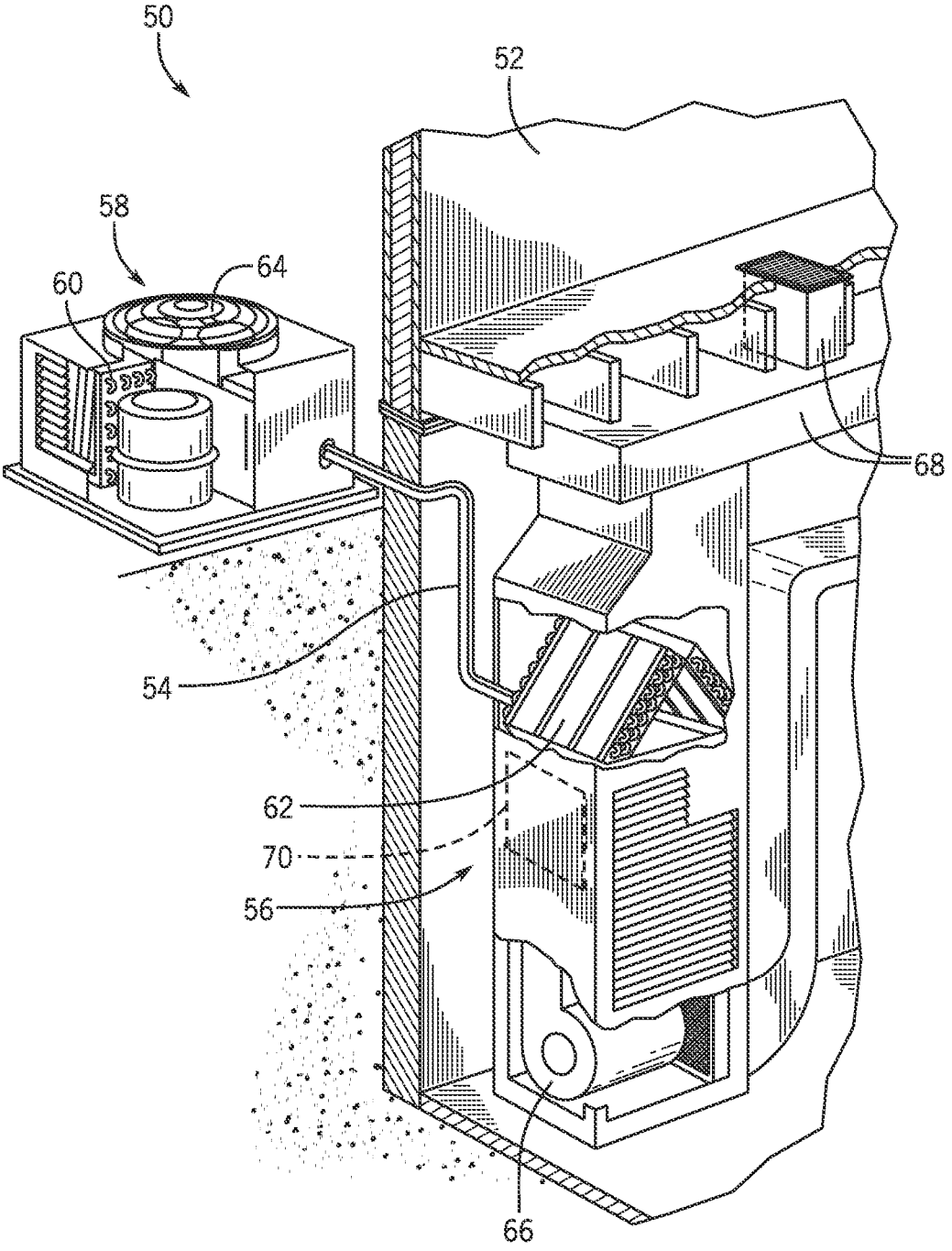
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
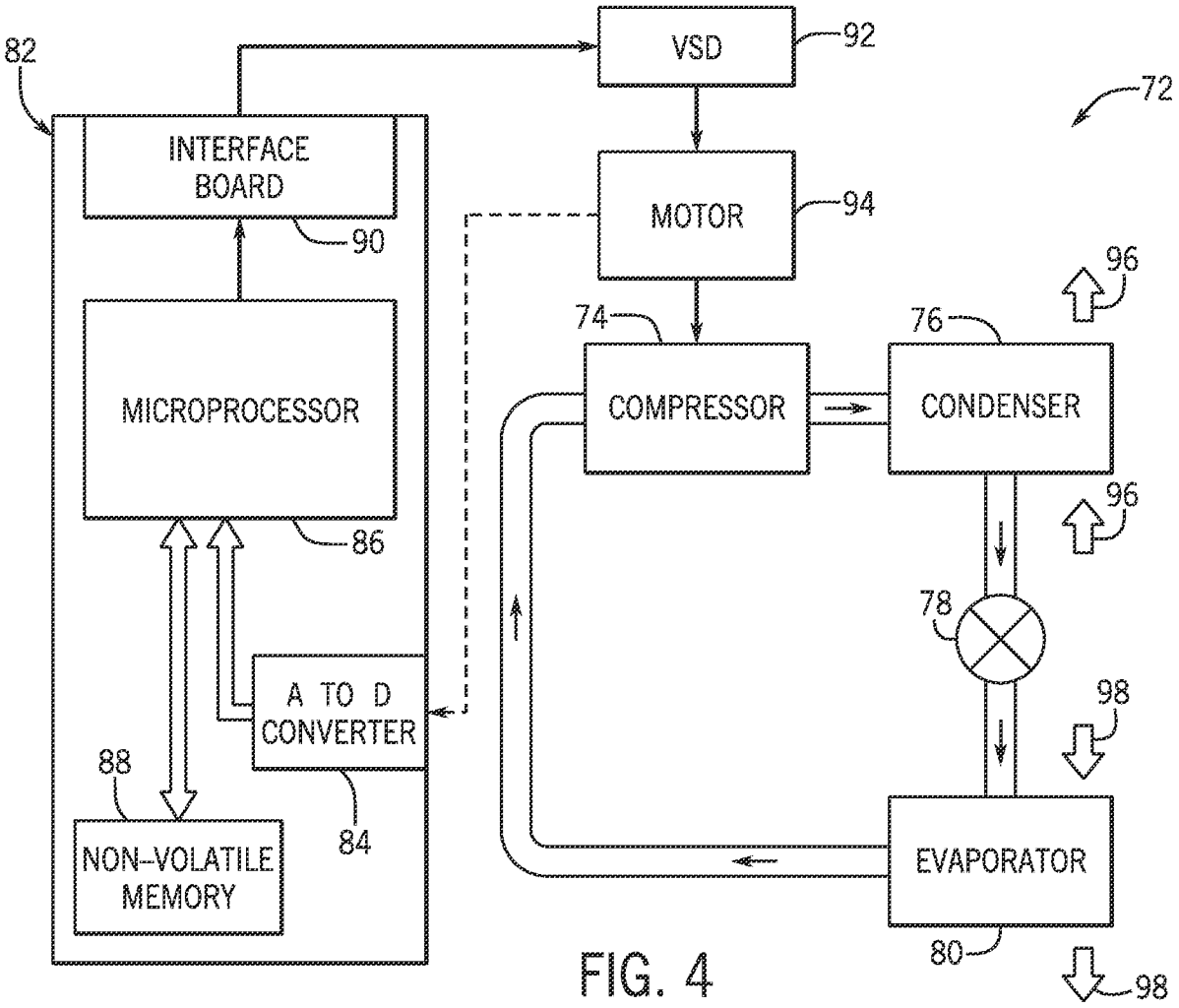
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, an HVAC system, such as the HVAC unit 12 and/or the residential heating and cooling system 50, may include a refrigerant circuit configured to circulate a refrigerant through various components in order to condition an environment or space. In accordance with present techniques, the HVAC system may include an auxiliary heat exchanger configured to place the refrigerant in a heat exchange relationship with ambient air. For example, the HVAC system may have a housing that encloses various components of the HVAC system, and the auxiliary heat exchanger may be coupled to the housing, such that heat may be transferred from the refrigerant to the housing via conduction and then transferred to ambient air via convection. Thus, the refrigerant may be cooled in the auxiliary heat exchanger without operating additional mechanical components, such as fans, that may increase energy consumption of the HVAC system. The auxiliary heat exchanger may be configured to be retrofit onto existing HVAC systems. That is, the auxiliary heat exchanger may be readily installed within a housing of an existing HVAC system, such that the refrigerant of the HVAC system may be directed to the auxiliary heat exchanger in order to increase the capacity for cooling the refrigerant. As used herein, the auxiliary heat exchanger is implemented as a condenser configured to remove heat from the refrigerant. However, in additional or alternative embodiments, the auxiliary heat exchanger may be implemented as an evaporator configured to add heat to the refrigerant, such as in a heat pump system configured to heat the supply air flow. Furthermore, although this disclosure primarily discusses implementing the auxiliary heat exchanger in a rooftop unit, in alternative embodiments, the auxiliary heat exchanger may be implemented in other types of HVAC systems, such as with a condenser in a split HVAC system.

Figure 5:
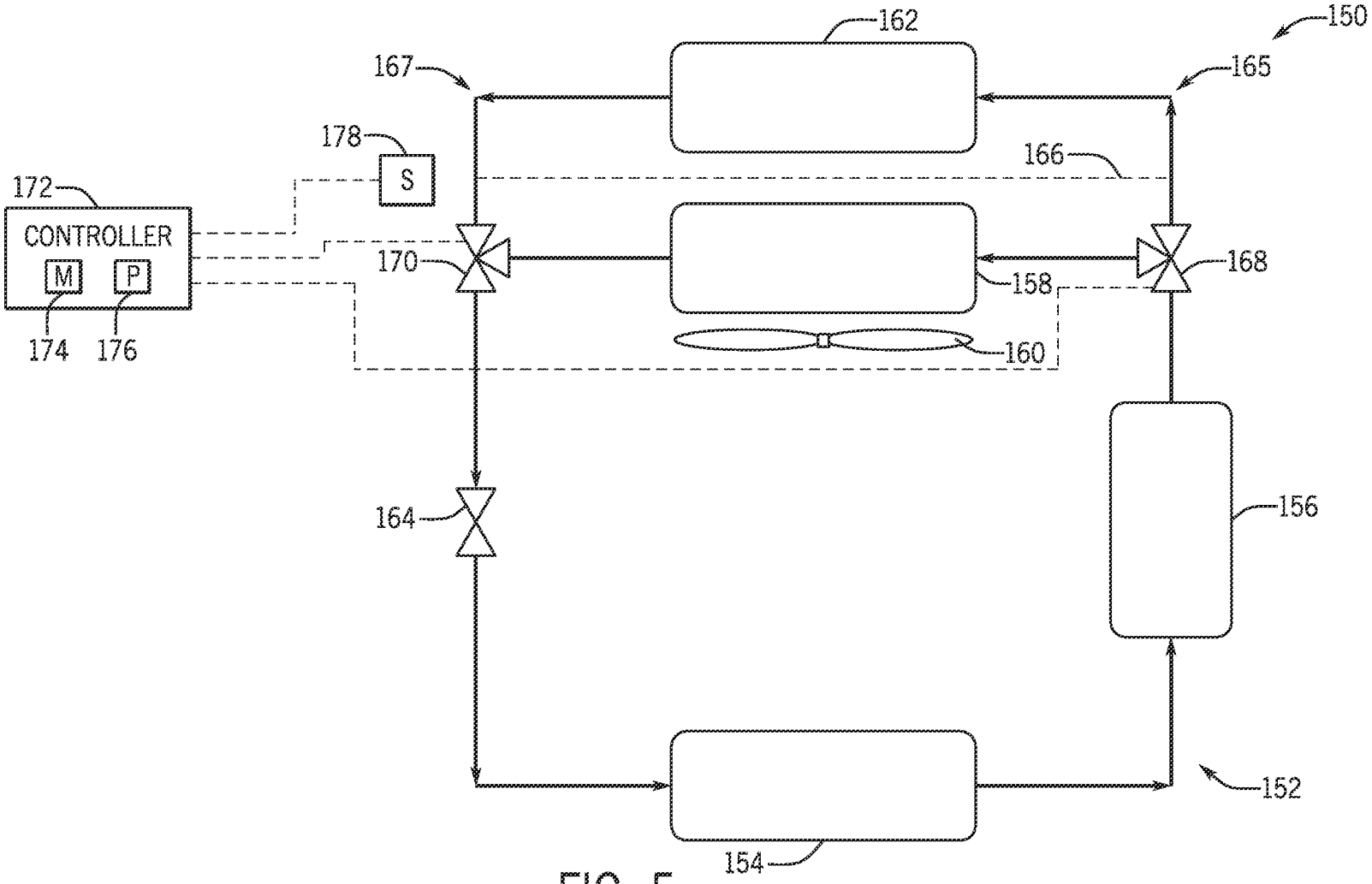
FIG. 5 is a schematic of an HVAC system having an auxiliary heat exchanger, in accordance with an aspect of the present disclosure.

FIG. 5 is a schematic view of an HVAC system 150 that may include a refrigerant circuit 152 configured to circulate a refrigerant therethrough. The refrigerant circuit 152 may include an evaporator 154 configured to place the refrigerant in a heat exchange relationship or in thermal communication with an air flow to condition the air flow. For example, the refrigerant may absorb thermal energy from the air flow to cool the air flow and heat the refrigerant. The refrigerant circuit 152 may also include a compressor 156 configured to pressurize the heated refrigerant and direct the heated refrigerant to a first condenser 158 forming part of the refrigerant circuit 152. The first condenser 158 is configured to remove thermal energy from and cool the heated refrigerant. For example, the HVAC system 150 may include a fan 160 configured to force or draw air across the first condenser 158 to remove thermal energy from the refrigerant. In some embodiments, the condenser 158 may include a plurality of tubes, conduits, and/or channels through which the refrigerant flows. The fan 160 may direct air across the plurality of tubes, conduits, and/or channels to remove thermal energy from the refrigerant directed through the condenser 158. Additionally, the HVAC system 150 includes a second condenser 162, such as an auxiliary condenser, forming a portion of the refrigerant circuit 152 and configured to receive and cool the refrigerant from the compressor 156. The second condenser 162 may expose the refrigerant to ambient air in order to transfer heat between the refrigerant and ambient air without operating another fan or other component to cool the refrigerant. In certain implementations, the refrigerant circuit 152 may further include an expansion device 164, such as the expansion device 78, configured to receive the refrigerant from the first condenser 158 and/or second condenser 162 and to reduce a pressure of the refrigerant. The reduction of pressure may further cool the refrigerant to place the refrigerant in condition to remove heat from the air flow at the evaporator 154.

In some embodiments, the second condenser 162 may be coupled to or otherwise positioned on a portion of the HVAC system 150 that is exposed to ambient air. For example, the HVAC system 150 may include a housing, in which at least a portion of a wall of the housing is exposed to ambient air. Thus, the second condenser 162 may be coupled to the wall of the housing in order to transfer heat with the wall exposed to ambient air. The pressure drop of refrigerant across the second condenser 162 may be less than the pressure drop of refrigerant across the first condenser 158 because less energy may be used to direct the refrigerant through the second condenser 162 as compared to the energy used to direct the refrigerant through the first condenser 158. In this manner, the additional energy consumption used to direct the refrigerant through the second condenser 162 may be relatively small, and thus, the inclusion of the second condenser 162 in the HVAC system 150 may not substantially increase overall energy consumption of the HVAC system 150.

Additionally, the HVAC system 150 may include a barrier 166 configured to block air directed by the fan 160 from flowing across or along the second condenser 162. As such, the fan 160 does not directly cause air to flow across or along the second condenser 162. Furthermore, the barrier 166 may thermally insulate the second condenser 162 from a remainder of the HVAC system 150, such as from the first condenser 158. Thus, heat may not transfer between the second condenser 162 and the remainder of the HVAC system 150. In certain embodiments, the barrier 166 may be adjustable, such as via adjustable louvers. That is, the barrier 166 may be adjusted between a closed position to block air from being directed across the second condenser 162 via the fan 160, a fully open position to enable air to be directed across the second condenser 162 via the fan 160, or a position between the closed position and the fully open position to enable a target amount of air to be directed across the second condenser 162 via the fan 160.

The refrigerant circuit 152 may also include a first conduit assembly 165, which includes components, such as conduits, tubing, flow paths, valves, and so forth, to direct the refrigerant from the compressor 156 to the first and second condensers 158, 162. In some embodiments, the first conduit assembly 165 may be configured to direct the refrigerant through the first condenser 158 and the second condenser 162 in a parallel arrangement. In other words, the first conduit assembly 165 may direct a first portion of the refrigerant from the compressor 156 directly to the first condenser 158 and a second portion of the refrigerant from the compressor 156 directly to the second condenser 162, such that the first portion of the refrigerant does not flow through the second condenser 162, and the second portion of the refrigerant does not flow through the first condenser 158. For example, the first conduit assembly 165 may include a first valve 168 configured to split a total amount of refrigerant discharged from the compressor 156 between the first and second condensers 158, 162. The first valve 168 may be configured direct the first portion of refrigerant discharged from the compressor 156 to the first condenser 158 and the second portion of refrigerant discharged from the compressor 156 to the second condenser 162.

The refrigerant circuit 152 may also include a second conduit assembly 167 configured to direct refrigerant from the first and second condensers 158, 162 to a second valve 170. The second valve 170 is configured to receive and combine the first portion of the refrigerant from the first condenser 158 and the second portion of the refrigerant from the second condenser 162. The second valve 170 may direct the combined first and second portions of the refrigerant to the expansion device 164. In additional or alternative embodiments, the first conduit assembly 165 may be configured to direct refrigerant from the compressor 156 to the first condenser 158 and the second condenser 162 in a series arrangement. That is, the first conduit assembly 165 may direct refrigerant from the compressor 156 to the first condenser 158 and then to the second condenser 162 in a sequential order.

The HVAC system 150 may include a controller 172, such as the control board 47 and/or the control panel 82, configured to control operation of the HVAC system 150. The controller 172 may include a memory 174 and a processor 176. The memory 174 may be a mass storage device, a flash memory device, removable memory, or any other non-transitory computer-readable medium that includes instructions for the processor 176 to execute. The memory 174 may also include volatile memory such as randomly accessible memory (RAM) and/or non-volatile memory such as hard disc memory, flash memory, and/or other suitable memory formats. The processor 176 may execute the instructions stored in the memory 174.

For example, the controller 172 may be communicatively coupled to the first valve 168 and/or the second valve 170 to adjust the amounts of refrigerant directed to the first condenser 158 and the second condenser 162. Generally, an increased amount of refrigerant directed through either of the condensers 158, 162 indicates an increased cooling load, or an increased amount of cooling of the refrigerant, performed by that condenser 158, 162. In some embodiments, the controller 172 may adjust a position of the first valve 168 to increase or decrease the ratio between the first portion and the second portion of refrigerant based on an operating parameter of the HVAC system 150 determined by a sensor 178. That is, for example, the first valve 168 may be adjusted such that a greater amount of refrigerant is directed through the second condenser 162 relative to an amount of refrigerant directed through the first condenser 158, or vice versa.

For instance, the operating parameter determined by the sensor 178 may include a temperature of the ambient air, a temperature of the refrigerant, a pressure of the refrigerant, a desired temperature of the supply air flow, another suitable operating parameter of the HVAC system 150, or any combination thereof. As an example, the first valve 168 may direct a greater amount of refrigerant through the second condenser 162 upon determining that the temperature of the ambient air is below a threshold value. As such, the refrigerant may be placed in thermal communication with ambient air having a relatively low temperature via the second condenser 162, which may remove a target amount of heat with less energy consumption as compared to removing heat from the refrigerant in the first condenser 158 via the fan 160. In one example, the second condenser 162 may have a cooling load of approximately 3 percent of a total cooling load of a 40 ton HVAC system when the temperature of the ambient air is at 35 degrees Celsius, and the second condenser 162 may have a cooling load of approximately 30 percent of the total cooling load of the 40 ton HVAC system when the temperature of the ambient air is at 18 degrees Celsius. In another example, the second condenser 162 may have a cooling load of approximately 8 percent of a total cooling load of a 3 ton HVAC system when the temperature of the ambient air is at 35 degrees Celsius, and the second condenser 162 may have a cooling load of approximately 80 percent of the total cooling load of the 3 ton HVAC system when the temperature of the ambient air is at 18 degrees Celsius.

In certain embodiments, the controller 172 may adjust the speed of the fan 160 based on an amount of refrigerant directed through the first condenser 158. For example, if the amount of refrigerant directed through the first condenser 158 decreases, such that the cooling load of the first condenser 158 decreases, an operating speed of the fan 160 may also be decreased by the controller 172 to reduce energy consumption associated with operating the fan 160.

The controller 172 may also be configured to adjust a position of the first valve 168 and/or the second valve 170 to block refrigerant flow through one of the condensers 158, 162. By way of example, the controller 172 may adjust the position of the first valve 168 to block the first portion of refrigerant from flowing from the compressor 156 to the first condenser 158 in response to the sensor 178 determining the temperature of ambient air is below a certain temperature, such as a temperature value between 0 degrees Celsius and 10 degrees Celsius. That is, the HVAC system 150 may be able to achieve a desired amount of cooling of the refrigerant by directing the refrigerant through the second condenser 162 and not the first condenser 158. In such circumstances, operation of the fan 160 may be disabled or suspended to reduce energy consumption, and the position of the second valve 170 may be adjusted to enable the refrigerant to flow from the second condenser 162 to the expansion valve 164 and block the refrigerant from flowing from the second condenser 162 to the first condenser 158.

The controller 172 may also adjust the position of the first valve 168 to block the second portion of refrigerant from flowing from the compressor 156 to the second condenser 162 in response to the sensor 178 determining the temperature of ambient air exceeds a threshold temperature, such as a temperature value between 30 degrees Celsius and 40 degrees Celsius. In other words, if the temperature of ambient air is too high, the refrigerant may not be sufficiently cooled by exchanging heat with the ambient air, and thus, the refrigerant may be blocked from flowing through the second condenser 162. Additionally, in such circumstances, the controller 172 may also adjust the position of the second valve 170 to direct refrigerant from the first condenser 158 to the expansion device 164 and block refrigerant flow from the first condenser 158 to the second condenser 162.

In some embodiments, the controller 172 may adjust the positions of the first and second valves 168, 170 to direct refrigerant based on a condition of the HVAC system 150. For example, frost may accumulate at a particular location, such as an exterior surface, of the HVAC system 150, which may impact a performance of the HVAC system 150. In response to determining that frost is accumulating on or in the HVAC system 150, the controller 172 may adjust a position of the first and/or second valves 168, 170 to direct heated refrigerant, such as refrigerant discharged by the compressor 156, to defrost such sections. For instance, the second condenser 162 may be located proximate to the exterior surface of the HVAC system 150 housing, and the controller 172 may adjust the position of the first and/or second valves 168, 170 to increase the amount of refrigerant directed to the second condenser 162 to defrost the exterior surface.

Although FIG. 5 illustrates a configuration of the HVAC system 150 having the first valve 168 and the second valve 170, in additional or alternative embodiments, the refrigerant circuit 152 may include other valve configurations to adjust an amount of refrigerant flow through the first condenser 158 and the second condenser 162. For example, the refrigerant circuit 152 may include a first valve configured to adjust an amount of refrigerant directed from the compressor 156 to the first condenser 158, a second valve configured to adjust an amount of refrigerant directed from the compressor 156 to the second condenser 158, a third valve configured to adjust an amount of refrigerant directed from the first condenser 158 to the expansion device 164, and/or a fourth valve configured to adjust an amount of refrigerant directed from the second condenser 162 to the expansion device 164.

Figure 6:
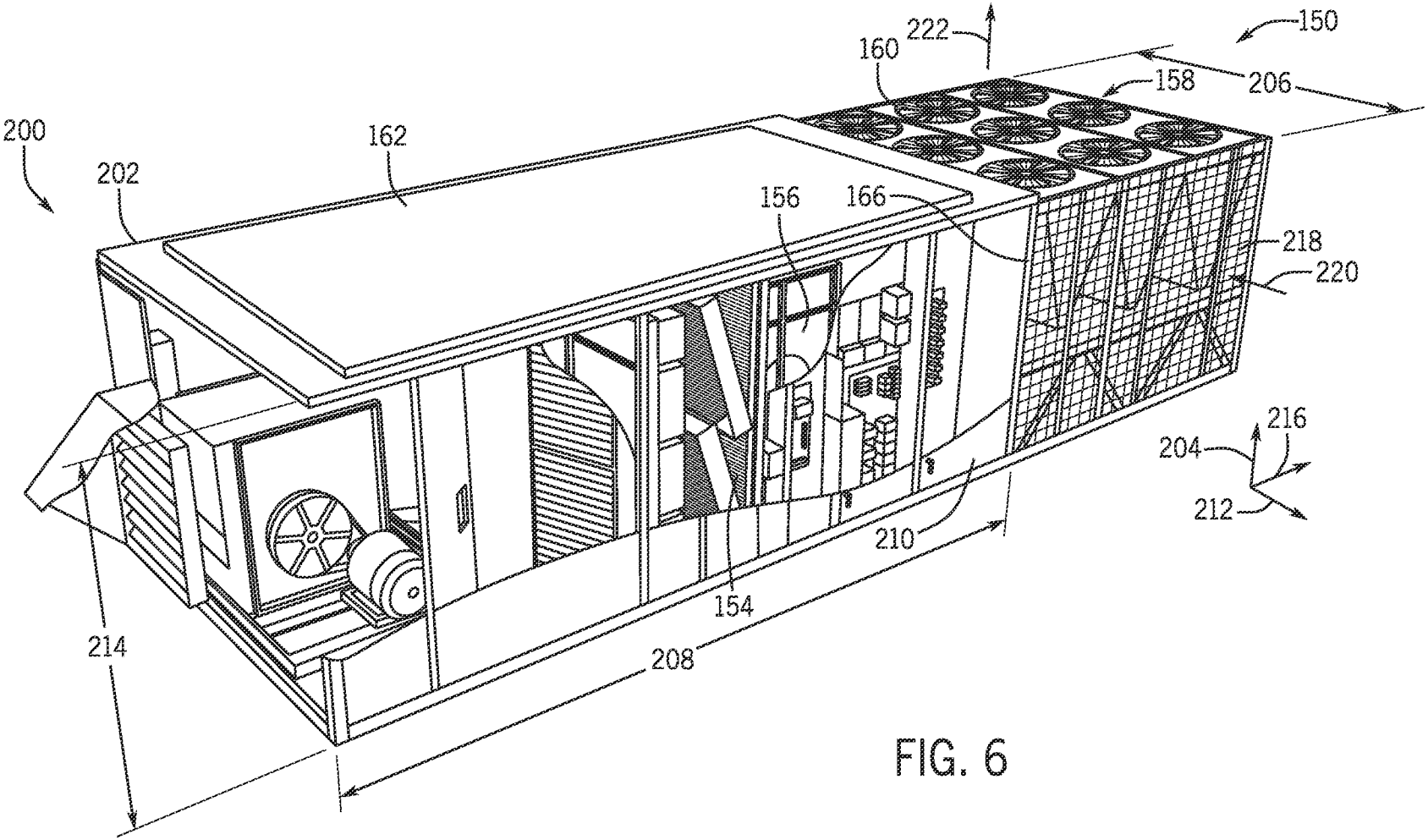
FIG. 6 is a cutaway perspective view of an embodiment of the HVAC system of FIG. 5 having a condenser and the auxiliary condenser, where the HVAC system is configured to be disposed exterior to a building conditioned by the HVAC system, in accordance with an aspect of the present disclosure.

FIG. 6 is a cutaway perspective view of an embodiment of the HVAC system 150 having the first condenser 158 and the second condenser 162, where the HVAC system 150 is configured to be disposed external to a building conditioned by the HVAC system 150. For example, the HVAC system 150 may be a packaged unit and/or an RTU, such as the HVAC unit 12 of FIGS. 1 and 2. The HVAC system 150 may include a housing 200, which encloses the evaporator 154, the compressor 156, the first condenser 158, and/or the second condenser 162. Furthermore, the second condenser 162 may be configured to be coupled to an interior surface of a wall or panel of the housing 200, whereby an exterior surface of the wall may be exposed to an ambient environment. In some embodiments, the second condenser 162 may be coupled to a top panel 202 of the housing 200, which may be positioned above the evaporator 154 and the compressor 156 with respect to a vertical axis 204. As an example, the top panel 202 may include a rectangular shape having a first length 206 that may be between 200 centimeters (cm) and 300 cm and a second length 208 that may be between 800 cm and 900 cm. In additional or alternative embodiments, the second condenser 162 may be coupled to a side panel 210 of the housing 200, which may be positioned adjacent to the evaporator 154 and the compressor 156 with respect to a lateral axis 212. The side panel 210 may also have a rectangular shape having the second length 208 and having a third length 214 that may each be between 100 cm and 200 cm. In further embodiments, the second condenser 162 may be coupled to another wall of the housing 200, such as a wall surrounding and/or enclosing the first condenser 158.

As illustrated in FIG. 6, the first condenser 158 is positioned adjacent to the evaporator 154, the compressor 156, and the second condenser 162 with respect to a longitudinal axis 216. As such, the first portion of the refrigerant discharged by the compressor 156 may be directed along the longitudinal axis 216 to the first condenser 158, and the second portion of the refrigerant discharged by the compressor 156 may be directed along the vertical axis 204 and/or the lateral axis 212 to the second condenser 162. Furthermore, the first condenser 158 includes a plurality of fans 160 positioned above condenser coils 218 of the first condenser 158 with respect to the vertical axis 204. The plurality of fans 160 may force or draw ambient air into the first condenser 158, such as in a first direction 220, across the condenser coils 218 within the housing 200, and out of the housing 200 in a second direction 222 away from the housing 200, the first condenser 158, and the second condenser 162. The illustrated embodiment of FIG. 6 includes the barrier 166 disposed between the first condenser 158 and the second condenser 162, in which the barrier 166 blocks ambient air directed by the plurality of fans 160 from flowing across the top panel 202 and/or the side panel 210. However, as discussed herein, in alternative embodiments, the barrier 166 may be adjustable or may be removed to enable the plurality of fans 160 to direct some air across the top panel 202 and/or the side panel 210 and across the second condenser 162. In further embodiments, a position of the fans 160 may be adjusted to enable air to be directed across the second condenser 162 via the fans 160.

Figure 7:
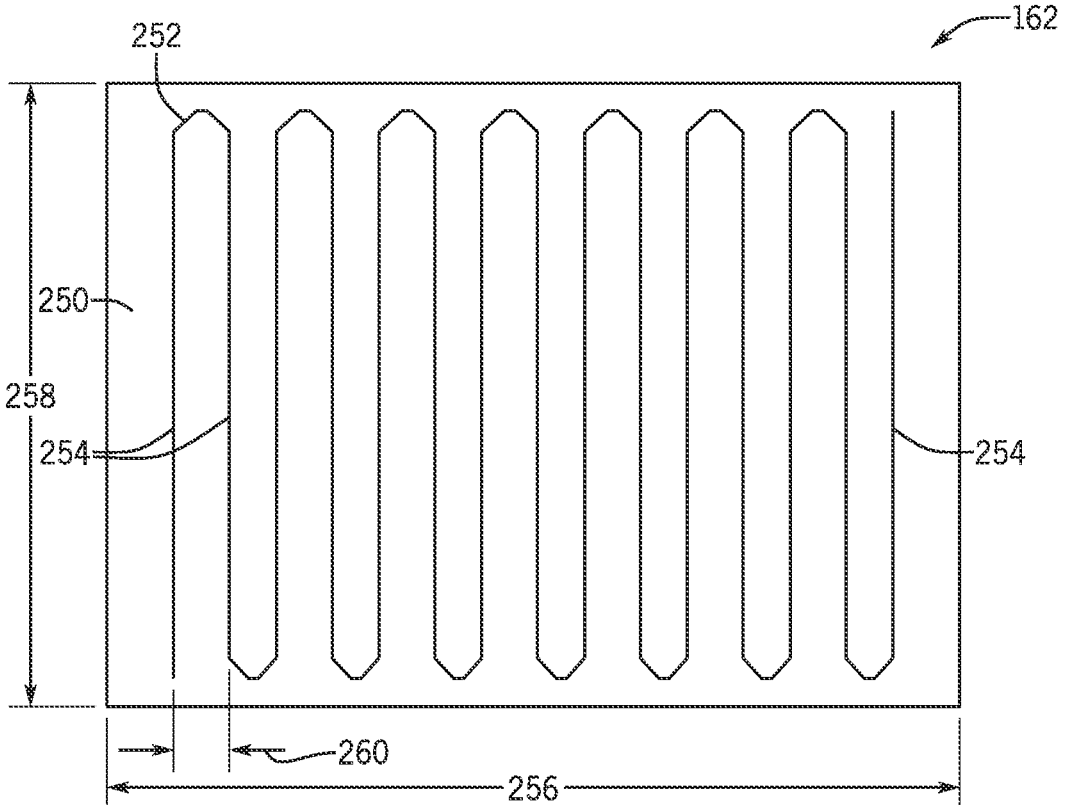
FIG. 7 is a schematic of an embodiment of an auxiliary condenser coupled to a wall of an HVAC system, in accordance with an aspect of the present disclosure.

FIG. 7 is a schematic of an embodiment of the second condenser 162 coupled to a wall 250 of the HVAC system 150, such as the top panel 202 and/or the side panel 210. The second condenser 162 includes a coil 252 that is disposed along a section of the wall 250. In the illustrated embodiment, the coil 252 is disposed in a zigzag or serpentine arrangement along a surface of the wall 250. The coil 252 includes a plurality of coil segments 254 that are disposed adjacent to one another along a longitudinal length 256 of the wall 250, and each coil segment 254 extends substantially parallel to one another along a lateral length 258 of the wall 250. In some embodiments, each coil segment 254 may be separated from an adjacent coil segment 254 by a distance 260. The distance 260 may be set or selected to enable a desirable amount of heat transfer between the refrigerant and the ambient environment and may be between 25 millimeters (mm) and 75 mm. Additionally, the coil 252 may have a total length of between 100 meters (m) and 150 m extending across the wall 250.

Figure 8:
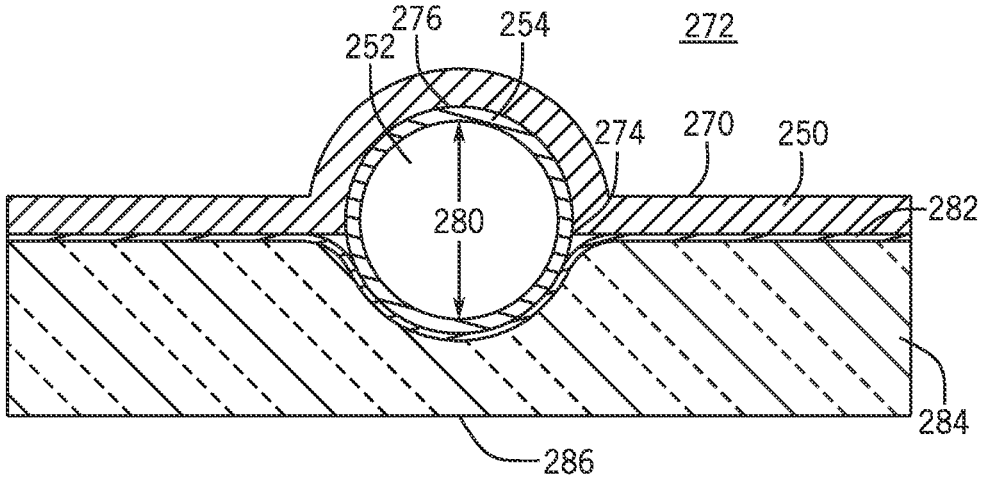
FIG. 8 is a schematic cross-sectional view of an embodiment of a coil of the auxiliary condenser coupled to the wall, in accordance with an aspect of the present disclosure.

FIG. 8 is a schematic cross-sectional view of an embodiment of the coil 252 coupled to the wall 250 having an exterior surface 270 that is exposed to an ambient environment 272. In some embodiments, the coil 252 may be directly coupled to, or directly in contact with, an interior surface 274 of the wall 250 to enable heat to transfer from the refrigerant within the coil 252 to the wall 250 via conduction. For example, grooves or recesses 276 may be formed or machined into the interior surface 274. The groove 276 may receive the coil 252 and may be formed to match the shape of the coil 252, such that the coil 252 is in contact with an increased amount of the wall 250 to enable a greater amount of heat transfer between the coil 252 and the wall 250. For example, the coil 252 is at least partially surrounded by the interior surface 274 of the wall 250, thereby increasing an amount of surface area of the coil 252 in contact with the wall 250. In the illustrated embodiment, the coil 252 has a circular cross-sectional geometry and may have a diameter 280 between 5 mm and 10 mm, and the groove 276 has a semicircular cross-sectional geometry to surround, contact, and/or capture approximately 50% of the circumference of the coil 252. However, in additional or alternative embodiments, the coil 252 may have a different cross-sectional geometry, and the groove 276 may have corresponding cross-sectional geometry to receive and/or surround at least a portion of the perimeter of the coil 252. Moreover, to enable greater heat transfer between the wall 250 and the coil 252, the wall 250 and/or the coil 252 may be formed from a metallic material, such as aluminum, steel, iron, another suitable material, or any combination thereof.

In some embodiments, conductive tape 282 may be used to couple and/or secure the coil 252 within the groove 276 of the wall 250. The conductive tape 282 may use adhesives to attach the coil 252 onto the interior surface 274 of the wall 250 and may facilitate heat transfer from the coil 252 to the wall 250. As an example, the conductive tape 282 may include a metallic or otherwise conductive material, such as aluminum. In certain embodiments, insulation 284 may be placed over the coil 252 and/or the conductive tape 282 to block heat from transferring away from the wall 250 to a remainder of the HVAC system 150, such as an interior of the housing 200. For example, an interior partition 286, such as the barrier 166, may be positioned adjacent to the wall 250, and insulation 284 may be positioned between the interior partition 286 and the wall 250. The insulation 284 may also abut and press the coil 252 against the wall 250 and further secure the coil 252 onto the wall 250. As such, the insulation 284 substantially blocks heat from transferring from the coil 252 and/or the wall 250 to the interior partition 286. Furthermore, the insulation 284 also blocks or restricts an air flow, such as the air flow directed by the fan 160, from contacting the wall 250 and/or the coil 252. By way of example, the insulation 284 may be formed from a polymeric material, such as polyurethane foam.

Figure 9:
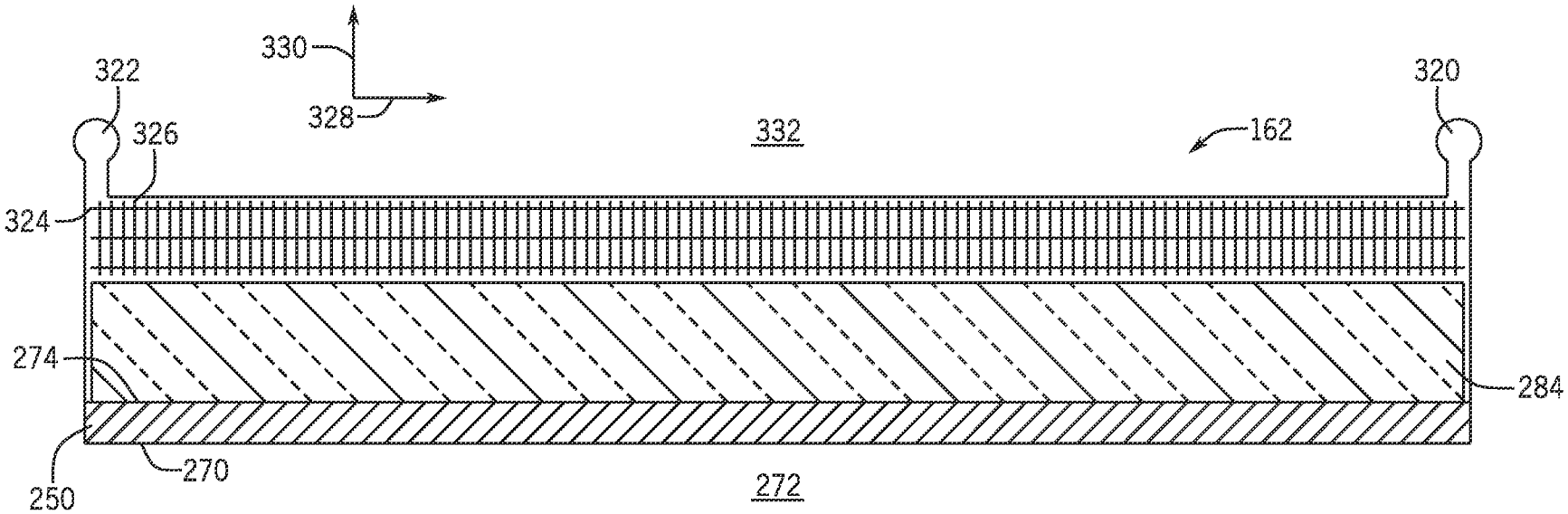
FIG. 9 is a schematic cross-sectional view of an embodiment of an auxiliary heat exchanger positioned adjacent to a wall of an HVAC system, in accordance with an aspect of the present disclosure.

FIG. 9 is a schematic cross-sectional view of another embodiment of the second condenser 162 positioned adjacent to the interior surface 274 of the wall 250 having the exterior surface 270 exposed to the ambient environment 272. For example, the second condenser 162 may be coupled to the insulation 284, and the insulation 284 may be coupled to the interior surface 274 of the wall 250. The insulation 284 of FIG. 9 may be made from the same or a different material than the insulation 284 of FIG. 9. For example, the insulation 284 of FIG. 9 may additionally or alternatively include a conductive filler, mixture, or other added material that may conduct thermal energy from the second condenser 162, through the insulation 284, and to the wall 250. That is, the conductive filler of the insulation 284, such as metallic particles, strips, tape, and/or another suitable filler, may increase an amount of heat that may travel through the insulation 284. As such, the insulation 284 may enable a sufficient amount of heat to transfer from the second condenser 162 to the wall 250 and to the ambient environment 272, thereby cooling the refrigerant flowing through the second condenser 162. In this manner, the second condenser 162 may be thermally coupled to the wall 250.

In some embodiments, the second condenser 162 may include a first header 320 and a second header 322. The refrigerant may enter the second condenser 162 via the first header 320, may flow through a plurality of conduits 324, which may each be similar to the coil 252, and may exit the second condenser 162 via the second header 322. Thus, the first header 320 may be fluidly coupled to the compressor 156 that directs refrigerant to the second condenser 162, and the second header 322 may be fluidly coupled to the expansion device 164 that receives the refrigerant from the second condenser 162. In some embodiments, the conduits 324 may each be channels, such that the second condenser 162 is a microchannel-type heat exchanger. Additionally or alternatively, the conduits 324 may each be tubes, and the second condenser 162 may be a shell and tube type heat exchanger. As shown in FIG. 9, the second condenser 162 includes three conduits 324 that each extend approximately parallel to one another and with respect to a longitudinal axis 328. However, in additional or alternative embodiments, the second condenser 162 may include any suitable number of conduits 324 that extend in any suitable manner, such as in a serpentine pattern, as described in FIG. 7. At least a portion of the conduits 324 may be thermally coupled to the insulation 284. That is, heat may transfer from the refrigerant, to the conduits 324, and to the insulation 284 toward the ambient environment 272.

Additionally, the second condenser 162 may include a plurality of fins 326 that contact each conduit 324, such that heat may transfer from the refrigerant to the conduits 324 and to the fins 326. For example, each conduit 324 may extend through and be in thermal communication with each fin 326. In additional or alternative embodiments, each conduit 324 may extend through some of the fins 326, but not all of the fins 326. Each fin 326 may also be coupled to the insulation 284, such that heat may transfer from the conduits 324, to the fins 326, and to the insulation 284 toward the ambient environment 272. Thus, the fins 326 may further enable heat transfer between the refrigerant and the ambient environment 272. Each fin 326 may be positioned cross-wise with respect to the conduits 324, such as along a lateral axis 330 that is perpendicular to the longitudinal axis 328.

In some embodiments, additional insulation may be disposed between the second condenser 162 and an interior 332 of the HVAC system 150. For example, the additional insulation may be positioned between the second condenser 162 and the interior partition 286 disposed within the interior 332 to block heat transfer between the second condenser 162 and a remainder of the HVAC system 150. The additional insulation may additionally or alternatively block an air flow from contacting the second heat exchanger 162, such as air directed by the fan 160.

Figure 10:
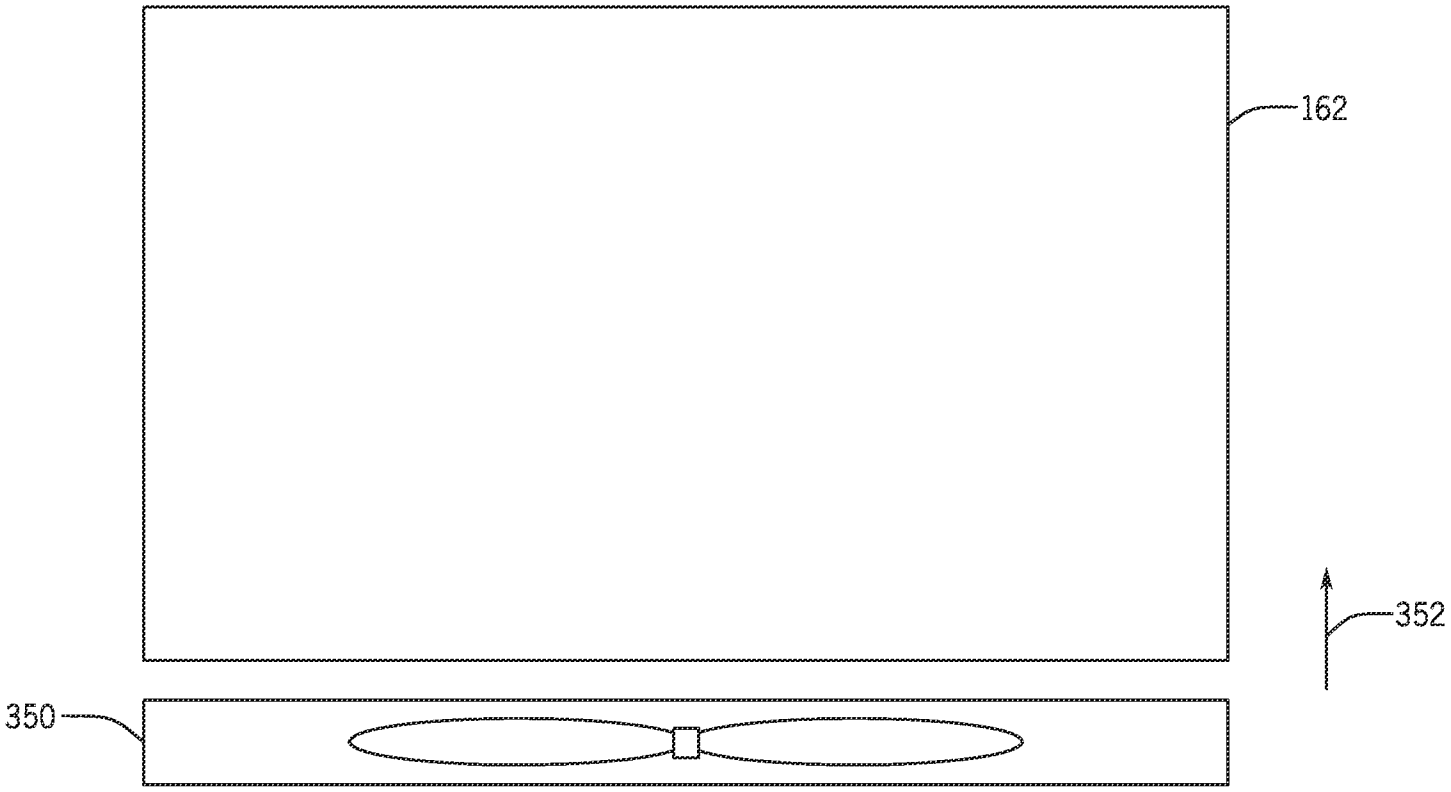
FIG. 10 is a schematic of an embodiment of an auxiliary condenser having a fan configured to direct air across the auxiliary condenser, in accordance with an aspect of the present disclosure.

FIG. 10 is a schematic of an embodiment of the second condenser 162 having a fan 350 configured to direct air across the second condenser 162. The fan 350 configured to direct air across the second condenser 162 may be different than the fan 160 configured to direct air across the first condenser 158. For example, the fan 350 may be configured to direct air across the second condenser 162 but not the first condenser 158. In some embodiments, the fan 350 may be configured to direct air generally along the second condenser 162. That is, the fan 350 may direct air in a direction 352 that is substantially parallel to the wall 250 of the embodiment of the second condenser 162 of FIGS. 7 and 8 or parallel to the fins 326 of the embodiment of the second condenser 162 of FIG. 9. Operation of the fan 350 may increase the rate that heat is removed from the refrigerant via forced convection. In some embodiments, the fan 350 may be a variable speed fan, whereby the rate at which the fan 350 directs air across the second condenser 162 may be adjustable. For example, the speed of the fan 350 may increase to increase the rate that heat is removed from the refrigerant, and vice versa. Although FIG. 10 illustrates one fan 350 configured to direct air across the second condenser 162, in additional or alternative embodiments, there may be multiple fans 350 configured to direct air across the second condenser 162. Each fan 350 may be independently controllable, such that the speed of each fan 350 may be adjusted to direct air across the second condenser 162.

The present disclosure may provide one or more technical effects useful in the operation of an HVAC system. For example, the HVAC system may cool a supply air flow by placing the supply air flow in a heat exchange relationship with a refrigerant directed through the HVAC system. The HVAC system may include a first heat exchanger configured to cool the refrigerant and place the refrigerant in condition to cool the supply air flow. For example, the HVAC system may utilize a fan that directs air across the first heat exchanger, such as a condenser, to cool the refrigerant flowing through the first heat exchanger. The HVAC system may also include a second heat exchanger, or an auxiliary heat exchanger, to provide further and/or alternative cooling of the refrigerant. The second heat exchanger may place the refrigerant in a heat exchange relationship with ambient air to enable heat to transfer between the refrigerant and ambient air without a mechanical component, such as an additional fan. Including the second heat exchanger may enhance a performance, such as an efficiency, of the HVAC system by increasing a cooling capacity of the refrigerant with a relatively small amount of additional energy consumption by the HVAC system. In some cases, the refrigerant may be sufficiently cooled via the second heat exchanger, such that the operation of the fan directing air across the first heat exchanger may be reduced. As such, energy consumption to operate the HVAC system is also reduced. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a housing comprising:

a wall configured to be exposed to an ambient environment external to a building serviced by the HVAC system, wherein the wall is configured to block air from flowing therethrough; and an outlet configured to discharge an air flow from the housing toward a space within the building;

a first heat exchanger disposed within the housing, wherein the first heat exchanger is configured to direct a refrigerant therethrough;

a second heat exchanger configured to direct the refrigerant therethrough, wherein the second heat exchanger comprises a coil coupled to the wall, and the coil is configured to transfer heat between the wall and the refrigerant directed through the second heat exchanger; and a third heat exchanger configured to receive the refrigerant from the second heat exchanger.

2. The HVAC system of claim 1, comprising a conduit assembly configured to direct the refrigerant to the first heat exchanger and the second heat exchanger in a series flow arrangement.

3. The HVAC system of claim 2, comprising a fan configured to direct the air flow across the third heat exchanger, through the outlet, into the building, and toward the space within the building.

4. The HVAC system of claim 1, wherein each of the first heat exchanger and the second heat exchanger is a condenser configured to cool the refrigerant.

5. The HVAC system of claim 1, wherein the second heat exchanger is coupled to an exterior surface of the wall.

6. The HVAC system of claim 1, wherein the wall is a top panel of the housing.

7. The HVAC system of claim 1, comprising a fan configured to direct an additional air flow across the first heat exchanger to cause heat transfer from the refrigerant to the additional air flow via the first heat exchanger.

8. A heating, ventilation, and/or air conditioning (HVAC) system, comprising:

a housing comprising a wall having an exterior surface configured to be exposed to an outdoor environment surrounding a building, wherein the wall is configured to block air from flowing therethrough;

a first heat exchanger disposed within the housing and configured to place a refrigerant in a heat exchange relationship with a first air flow;

a second heat exchanger comprising a coil coupled to the wall, wherein the coil is configured to direct the refrigerant therethrough, and the second heat exchanger is configured to place the refrigerant in a heat exchange relationship with the outdoor environment via the exterior surface of the wall;

a conduit assembly coupled to the first heat exchanger and to the second heat exchanger and configured to direct the refrigerant sequentially through the first heat exchanger and the second heat exchanger;

a third heat exchanger configured to receive the refrigerant from the second heat exchanger; and a fan configured to direct a second air flow across the third heat exchanger, through an outlet of the housing, and into the building.

9. The HVAC system of claim 8, wherein the second heat exchanger is coupled to an interior surface of the wall, and the interior surface is opposite the exterior surface.

10. The HVAC system of claim 9, wherein the second heat exchanger is directly mounted to the interior surface of the wall.

11. The HVAC system of claim 8, comprising an additional fan configured to direct the first air flow across the first heat exchanger.

12. The HVAC system of claim 11, comprising a barrier disposed between the first heat exchanger and the second heat exchanger, wherein the barrier is configured to block flow of the first air flow across the second heat exchanger.

13. The HVAC system of claim 12, wherein the barrier is configured to block flow of the first air flow across the second heat exchanger in a closed position, the barrier is configured to transition from the closed position to an open position, and the barrier is configured to enable the flow of the first air flow across the second heat exchanger in the open position.

14. A heating, ventilation, and/or air conditioning (HVAC) system, comprising:

a housing comprising:

a wall configured to be exposed to an ambient environment external to a building serviced by the HVAC system, wherein the wall is configured to block air from flowing therethrough; and an outlet configured to discharge an air flow from the housing and toward a space within the building;

a first heat exchanger disposed within the housing;

a second heat exchanger disposed within the housing, wherein the second heat exchanger comprises a coil directly mounted against the wall and configured to direct a refrigerant through the second heat exchanger, and the second heat exchanger is configured to enable heat transfer from the refrigerant to the ambient environment;

a third heat exchanger configured to receive the refrigerant from the second heat exchanger; and a fan configured to direct the air flow across the third heat exchanger, through the outlet, into the building, and toward the space.

15. The HVAC system of claim 14, wherein the wall comprises an exterior surface exposed to the ambient environment, and the second heat exchanger is coupled to the exterior surface.

16. The HVAC system of claim 14, wherein the second heat exchanger is configured to receive the refrigerant from the first heat exchanger.

17. The HVAC system of claim 14, comprising an additional fan configured to direct an additional air flow across the first heat exchanger and across the second heat exchanger.

18. The HVAC system of claim 14, comprising a compressor configured to pressurize the refrigerant and discharge pressurized refrigerant toward the first heat exchanger.

19. The HVAC system of claim 14, wherein the fan is configured to direct the air flow into ductwork fluidly connecting the outlet of the housing to the space.

20. The HVAC system of claim 14, wherein the third heat exchanger is an evaporator configured to transfer heat from the air flow to the refrigerant.

* * * * *